United States Patent [19]

Toland

[11] Patent Number: 4,805,914

[45] Date of Patent: Feb. 21, 1989

[54] GOLF BALL AND METHOD OF MAKING THE SAME

[76] Inventor: J. William Toland, 13011 Blanche Coker Dr., San Antonio, Tex. 78216

[21] Appl. No.: 903,679

[22] Filed: Sep. 4, 1986

[51] Int. Cl.[4] ..... A63B 37/08

[52] U.S. Cl. ..... 273/231; 141/4; 273/227; 273/58 H; 427/296; 427/407.1; 156/146; 264/102

[58] Field of Search ..... 273/231, 230, 220–227, 273/214, 215, 216, 228, 229, 58 H

[56] References Cited

U.S. PATENT DOCUMENTS 889,709 6/1908 Mingay ..... 273/231 X 2,074,808 3/1937 Richey ..... 273/215

2,264,604 12/1941 Young ..... 273/230

OTHER PUBLICATIONS

"Elementary Fluid Mechanics", John K. Vennard, 3rd edition, John Wiley and Sons, Inc., New York, Apr. 1955, pp. 366–375.

*Primary Examiner*—George J. Marlo

*Attorney, Agent, or Firm*—Cox & Smith Inc.

[57] ABSTRACT

A game ball, particularly a golf ball, having a liquid core, in which some portion of the dissolved gases in the liquid are removed to decrease the compressability of the liquid core.

6 Claims, 1 Drawing Sheet

GOLF BALL AND METHOD OF MAKING THE SAME

BACKGROUND OF THE INVENTION

This invention relates to game balls, particularly golf balls, and the method of manufacturing the same. More particularly, this invention relates to a ball having a liquid core of decreased compressability.

Although this invention finds particular utility in golf balls, the invention is applicable to any liquid center game ball where it is necessary or desirable to vary the degree of compressability of the center.

Liquid center golf balls today are produced by providing a body of liquid in a spherical envelope as the core or center about which thread or other wrappings are disposed. The wound body is then enclosed in a dimpled Balata or Surlyn cover. Various liquid materials have been used in the centers, for example water, liquid glue, paste and honey. Indeed, other materials have also been used, for example steel ball bearings, steel pellets, and oil-filled capsules.

Liquid has been considered one of the better, if not the best, materials for the center of a golf ball because liquid is known to be essentially non-compressable. A center which exhibits a decreased degree of compressability increases the immediacy of the transmittal of force of a golf club head striking the ball back to the club face. That force first compresses the ball against the club face and then causes the ball to rebound off of the club face resulting in an increase in accelleration away from the club face. That also results in a pleasing "click" and feel. The increase in acceleration provides a means to attain maximum velocity in a shorter period of time.

There have been a number of attempts at varying the compressability of a golf ball. For example, U.S. Pat. No. 2,074,808 to Rickey discloses a method of permeating a liquid core with a gaseous material, such as dry ice. The liquid core is frozen which causes the core to contract. Rickey teaches that if the ball is wound while the core is frozen, after the ball "thaws out" the core will expand, the gaseous material will evaporate, and the tensions on the windings will increase thereby rendering the ball harder than what could be effected by tensioning the winding alone.

Others have offered other designs. For example, U.S. Pat. No. 2,264,604 to Young discloses a ball using a solid pellet as the core. But in order to center the pellet in the center of the golf ball, Young first embeds the pellet in dry ice or some other readily liquifiable or gasifiable substance. When the core "thaws out", the gas escapes and the windings are said to force the pellet to the center of the ball.

Despite numerous attempts and years of varying designs, there have been very few, if any, successful solutions to the problem of varying the compressability of liquid center balls.

SUMMARY OF THE INVENTION

The present method and resulting product permits the construction of a ball having a liquid center of decreased compressability with a resultant higher acceleration rate off of the club face. That is effected by removing dissolved gases from the liquid in the liquid core thus rendering that liquid less compressable than previously. The present method also permits one to vary the degree of compressability by varying the amount of the dissolved gases which are removed. Thus, by varying the degree of center compressability either alone or in conjunction with varying the other construction details of the ball, f example the amount or tension on the windings, a ball may be designed having specific acceleration and characteristics with very little, if any, significant changes in the overall manufacturing process.

Therefore, one object of the present invention is to improve the construction of game balls, particulary golf balls, as well as the method of manufacturing the same, such that they may be economically manufactured and yet prove more efficient and desirable for play.

A further object of the present invention is to provide a game ball, particularly a golf ball, exhibiting a further distance when struck.

Yet another object of the present invention is to provide an improved game ball, particularly a golf ball, having a core of decreased compressability.

Yet a further object of the present invention is to provide a game ball, particularly a golf ball, exhibiting a pleasing click and feel.

A further object of the present invention is to provide a method of manufacturing a game ball, particularly a golf ball, which permits an easy and ready adjustment to compressability without a significant change to the overall manufacturing process.

Other objects, features, and advantages of the invention will become evident in light of the following detailed description considered in conjunction with the referenced drawing of a preferred exemplary embodiment according to the present invention.

DETAILED DESCRIPTION OF THE DRAWINGS

DETAILED DESCRIPTION OF THE INVENTION

Figure 1:
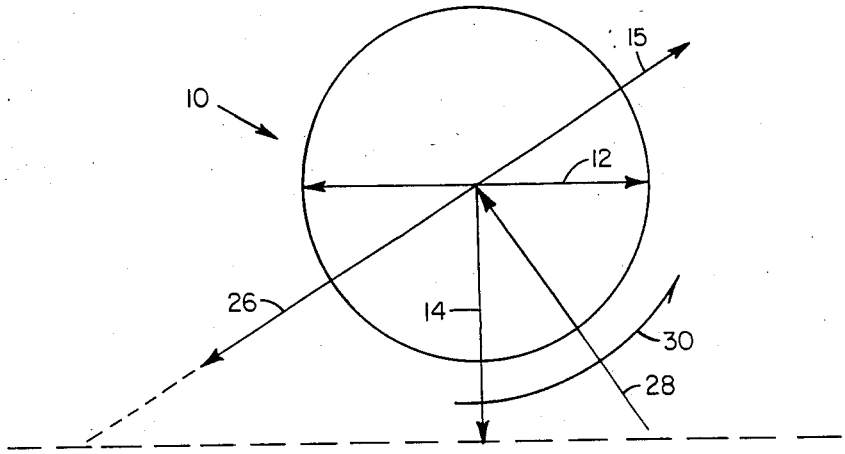
FIG. 1 illustrates the forces affecting a golf ball.

FIG. 1 illustrates the several forces at work on a golf ball. Aerodynamic and other forces at work on golf balls, game balls, and other objects hurled or driven through space are, of course, influenced by size. The U.S. Golf Association (USGA), however, has set a number of parameters which golf balls must meet in order to be approved for official play. One of those parameters is diameter 12. USGA regulations require a minimum diameter of 1.68 inches. Thus, golf ball diameters can be varied little, if at all.

Figure 2:
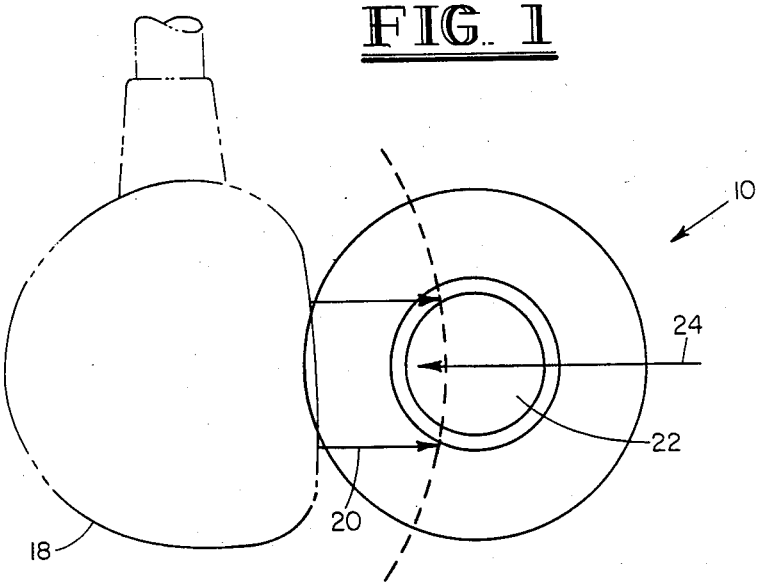
FIG. 2 illustrates the force applied by a club head to a golf ball.

Gravity 14, of course, is a constant force on all objects. One force working to overcome the effects of gravity is forward velocity 15. Referring to FIG. 2, when a golf ball 10 is struck by a club head 18, the power of the club head 18 is transmitted to the golf ball. Upon impact, a force 20 compresses the golf ball against the club face, as illustrated in phantom line. It should be noted that this description is for illustrative purposes only. The actual shape and extent of compression varies with the particular golf ball and club used. The golf ball center 22 stops the energy 20 being transmitted by the club head, and the golf ball 10 rebounds along force vector 24 in an attempt to restore itself to its original shape. The result is that the golf ball rebounds off the club head at some acceleration rate ultimately developing a maximum forward velocity along force vector 15

(FIG. 1). That acceleration rate is a principal factor in a golf ball's ability to overcome negative forces such as gravity 14. The USGA, by regulation, has limited initial forward velocity of an approved golf ball to a maximum of 250 feet per second. But it is the acceleration, not the velocity per se, which works to overcome the effects of gravity. Thus, improving the acceleration but still keeping within velocity limits holds the promise of increased golf ball performance.

Golf balls and other objects being propelled through air bear an aerodynamic resistence, i.e. drag, along force vector 26, which slows the ball's velocity. Dimpled surfaces on golf balls are intended to reduce the effects of aerodynamic drag and thus sustain the ball's velocity for a longer period of time. The flight characteristics of a golf ball may be adjusted by various dimpled designs of differing size, shape and depth, and different geometric patterns for the dimples.

The third positive aerodynamic factor is spin 30. When a golf ball is struck, it is launced with a back-spinning motion. That spin reduces drag and aids the lift. Spin also aids the directional orientation of a golf ball's flight.

Thus, upward launch angle of a golf ball along force vector 15, the dimples or other means to decrease aerodynamic drag, and spin 30 all produce an upward aerodynamic force, i.e. lift, along force vector 28.

As pointed out above, the USGA has set a number of regulations governing golf balls. For example, a ball may not weigh more than 1.620 ounces, measure less than 1.680 inches in diameter, and have a forward velocity of not greater than 250 feet per second when measured on the USGA apparatus at 75° F. A maximum tolerance of two percent (2%) is allowed on balls in the velocity test. Thus, golf ball manufacturers attempt to design their balls to achieve a forward velocity of as close to 255 feet per second as possible because it is widely believed that velocity leads to distance, and distance is what players desire. Providing a golf ball able to exhibit greater distances when struck, of course, results in increased sales.

There are two (2) general types of golf balls on the market today. One is a two-piece ball generally known as a solid ball. It is constructed of a molded man-made material covered with a dimpled cover made of a plastic or Surlyn cover.

Figure 3:
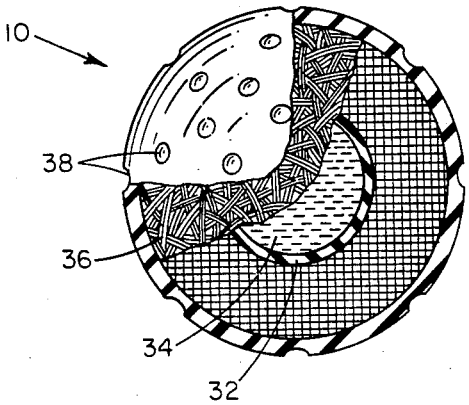
FIG. 3 illustrates a partial cross-sectional view of a golf ball produced according to the present invention.

The second type, and the type to which the present invention is specifically directed, is termed a wound or liquid center ball. Referring to FIG. 3, the center core of a wound or liquid center ball is usually a rubber or the like spherical hollow envelope 32 filled with a liquid 34. The liquid may be any one of a variety of materials such as water, paste, liquid glue, honey and the like.

In normal golf ball construction, the center is frozen and wrapped with a thread or winding 36. The winding is then covered with a dimpled Balata or Surlyn cover 38. Each of those parts of a golf ball contribute to the performance and "feel" of the ball. The dimples contribute to the aerodynamic effect of the ball, the cover 38 protects the thread and is a factor in the "feel" of the ball. The winding or thread 36 is the source of power and the center 34 assists the thread in supplying that power.

Again, as illustrated in FIG. 2, when a ball is struck by a club head, considerable power is transmitted to the ball. Upon impact, the ball 10 deflects or compresses and leaves the club face, at which time it attempts to restore itself to its original shape. The force applied to thread 36 (FIG. 3) by the club head flows through the thread to the center 22 (FIG. 2). If the center is compressable, much of the energy would continue through the center and be lost. The less compressable center 22 is, the more energy is sent back to thread 36, thus permitting the ball to recover its shape faster, and therefore making the ball perform better and increase distance after being struck.

Liquid has traditionally been considered the best for the center of a golf ball, because liquid is known to be *practically incompressable. Therefore, a liquid center* transmits the force of a blow at impact back to the club face to first compress the ball against the club face resulting in a quick "get away", i.e. increased acceleration, and a pleasing click and feel.

However, most liquids, especially water, contain dissolved gases to varying degrees. Because gases are compressable, liquids containing such dissolved gases will exhibit some degree of compressability, with the degree of compressability depending upon the amount of dissolved gases in the liquid. Removing the dissolved gases from the water or other liquid in the golf ball center results in a water or other liquid which is less compressable than the water or liquid in its natural state. That will result in a golf ball which has increased acceleration and will reach its maximum velocity quicker.

According the present invention, the liquid center 34 of a standard wound golf ball is filled with degassed water or other liquid from which dissolved gases have been removed to some degree. The actual compressability of the center can then be varied by varying the amount of the dissolved gases removed. Any of the known techniques, for example, the Nold DeAerator, may be used to remove the dissolved or entrapped gasses from the liquid. The ball is subsequently manufactured in the usual manner. It should be realized that various liquids will have varying amounts of dissolved gases. Thus the characteristics of the ball, including acceleration and velocity, can be varied by regulating the extent of the degasifying process and, of course, can also be varied by adjusting the tension on the winding or thread, the amount of winding or thread, the cover, the dimpling, and so forth. The present invention therefore adds an additional parameter which may be varied to achieve a resultant ball having acceleration, velocity, and distance characteristics as may be desired.

The invention may also be used in molded or so-called two-piece balls by inserting a degased liquid filled center in the molded interior of the ball.

Although the invention has been described in conjunction with the foregoing specific embodiment, many alternatives, variations and modifications are apparent to those of ordinary skill in the art. Those alternatives, variations and modifications are intended to fall within the spirit and scope of the appended claims.

I claim:

1. An improved game ball of the type having a liquid core wherein the liquid in said liquid core in its natural state contains dissolved gases wherein the improvement comprises:

removing a selected amount of the dissolved gases from said liquid to decrease the degree of compressibility of said liquid.

2. A game ball having a liquid core as set forth in claim 1 wherein the degree of compressibility is variable by varying the amount of the dissolved gases removed.

3. A game ball having a liquid core as set forth in claim 1 wherein substantially all of the dissolved gases in said liquid are removed.

4. An improved game ball of the type having a liquid core wherein the liquid in said liquid core is characterized by a decreased degree of compressibility as compared to said liquid in its natural state resulting from selected degasification of said liquid.

5. A method of making game balls of the type having ball centers adapted for liquid cores wherein the liquid in said liquid cores, in its natural state, contains dissolved gases, comprising:

variably degasifying sail liquid in said liquid centers by removing selected amounts of the dissolved gases in said liquid thereby decreasing the compressibility of said liquid;

introducing said degasified liquid into said ball center; and forming said game ball about such center.

6. A method of varying the compressibility of liquid cores in game balls having liquid centers comprising:

variably removing selected portions of dissolved gases in said liquid thereby varying the compressibility of said liquid.

* * * * *